US005902023A

United States Patent [19]

Yu et al.

[11] Patent Number: 5,902,023

[45] Date of Patent: May 11, 1999

[54] SPEAKER CABINET AND MONITOR HOUSING MOUNTING ARRANGEMENT

[75] Inventors: Robert Yu; Jyh-Shang Wang, both of Taipei Hsien, Taiwan

[73] Assignee: Proton Electronic Industrial Co., Ltd., Taipai Hsien, Taiwan

[21] Appl. No.: 09/003,693

[22] Filed: Jan. 7, 1998

[51] Int. Cl.[6] ..... A47B 5/00

[52] U.S. Cl. ..... 312/7.2; 361/681; 361/682; 381/386

[58] Field of Search ..... 312/7.1, 7.2, 265.6, 312/223.1, 223.2; 348/836, 839, 787; 361/681, 682, 683; 381/386, 388, 333

[56] References Cited

U.S. PATENT DOCUMENTS

| | | | |
|---|---|---|---|
| 2,902,688 | 9/1959 | Foster | 312/7.2 X |
| 5,452,025 | 9/1995 | Koizumi | 348/805 X |
| 5,566,242 | 10/1996 | Hall | 381/202 |
| 5,734,733 | 3/1998 | Starck | 381/188 |

OTHER PUBLICATIONS

"Monitors Make Music", Katie Barnes, http://www.zdnet.com/computershopper/edit/cshopper/content/9512/feature2/main.html, Dec. 1995.

*Primary Examiner*—Jose V. Chen
*Assistant Examiner*—Brian H. Buck
*Attorney, Agent, or Firm*—Bacon & Thomas

[57] ABSTRACT

A speaker cabinet and monitor housing mounting arrangement which includes a monitor housing having one opening near a back side thereof remote from the display screen mounted thereon, at least one retaining notch at a first end of the opening, and at least one locating slot at a second end of the opening; and a speaker cabinet mounted in the opening on the monitor housing, the speaker cabinet having a shock absorbing cushion mounted in a coupling groove at one end thereof adapted for holding a voice output device, at least one projecting rod at one end respectively fitted into at least one retaining notch at the first end of the opening on the monitor housing, and at least one hook at an opposite end respectively hooked on at least one locating slot at the second end of the opening on the monitor housing.

6 Claims, 3 Drawing Sheets

SPEAKER CABINET AND MONITOR HOUSING MOUNTING ARRANGEMENT

BACKGROUND OF THE INVENTION

The present invention relates to a speaker cabinet and monitor housing mounting arrangement which comprises a monitor housing having an opening remote from the display screen, and a speaker cabinet mounted in the opening, wherein the monitor housing has retaining notches and locating slots at two opposite ends of the opening; the speaker cabinet comprises a plurality of projecting rods at one end respectively forced into engagement with the retaining notches on the monitor housing, and a hook at an opposite end hooked on one locating slot on the monitor housing.

There are known computer monitors installed with a speaker system. The speaker cabinets of the speaker system are equipped with screws adapted for fastening to brackets inside the monitor housing. However, it is inconvenient to fasten the speaker cabinets of the speaker system to the brackets inside the monitor housing of the computer monitor by screws. Further, when the speaker system is operated at a high volume mode, shock waves are transmitted to the screws, thereby causing the screws to be loosened.

SUMMARY OF THE INVENTION

The present invention has been accomplished to provide a speaker cabinet and monitor housing mounting arrangement which eliminates the aforesaid problems. According to one aspect of the present invention, the speaker cabinet and monitor housing mounting arrangement comprises a monitor housing having one opening near a back side thereof remote from the display screen mounted thereon, at least one retaining notch at a first end of the opening, and at least one locating slot at a second end of the opening; and a speaker cabinet mounted in the opening on the monitor housing, the speaker cabinet having a coupling groove on the inside at one end which holds a voice output device, at least one projecting rod at one end respectively fitted into the at least one retaining notch at first end of the opening on the monitor housing, and at least one hook at an opposite end respectively hooked on at least one locating slot at the second end of the opening on the monitor housing. According to another aspect of the present invention a rubber cushion is mounted in the coupling groove within the speaker cabinet around the voice output device for absorbing shocks.

DETAILED DESCRIPTION OF THE PREFERRED EMBODIMENT

Figure 1:
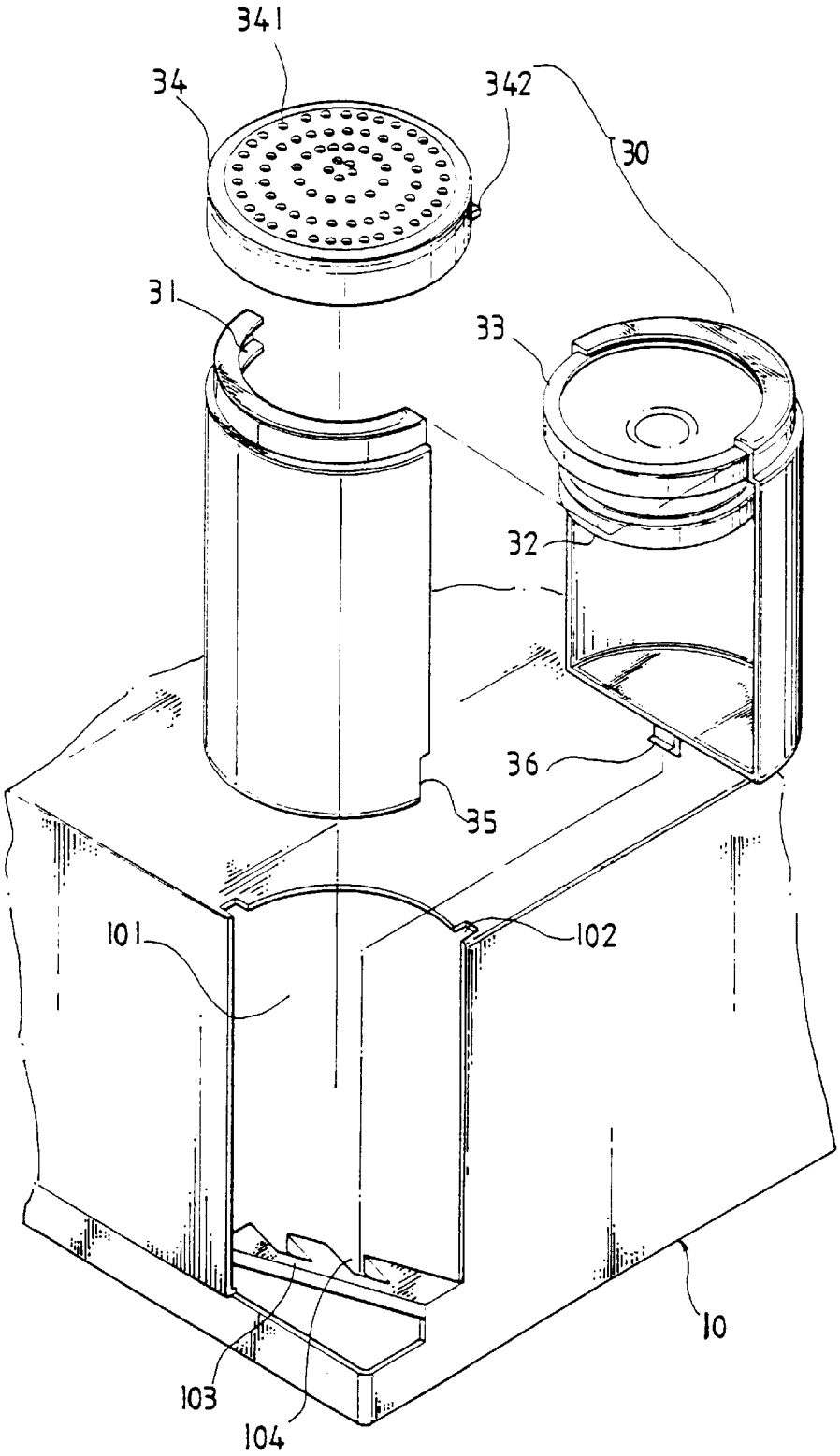
FIG. 1 is an exploded view of the present invention.
Figure 2:
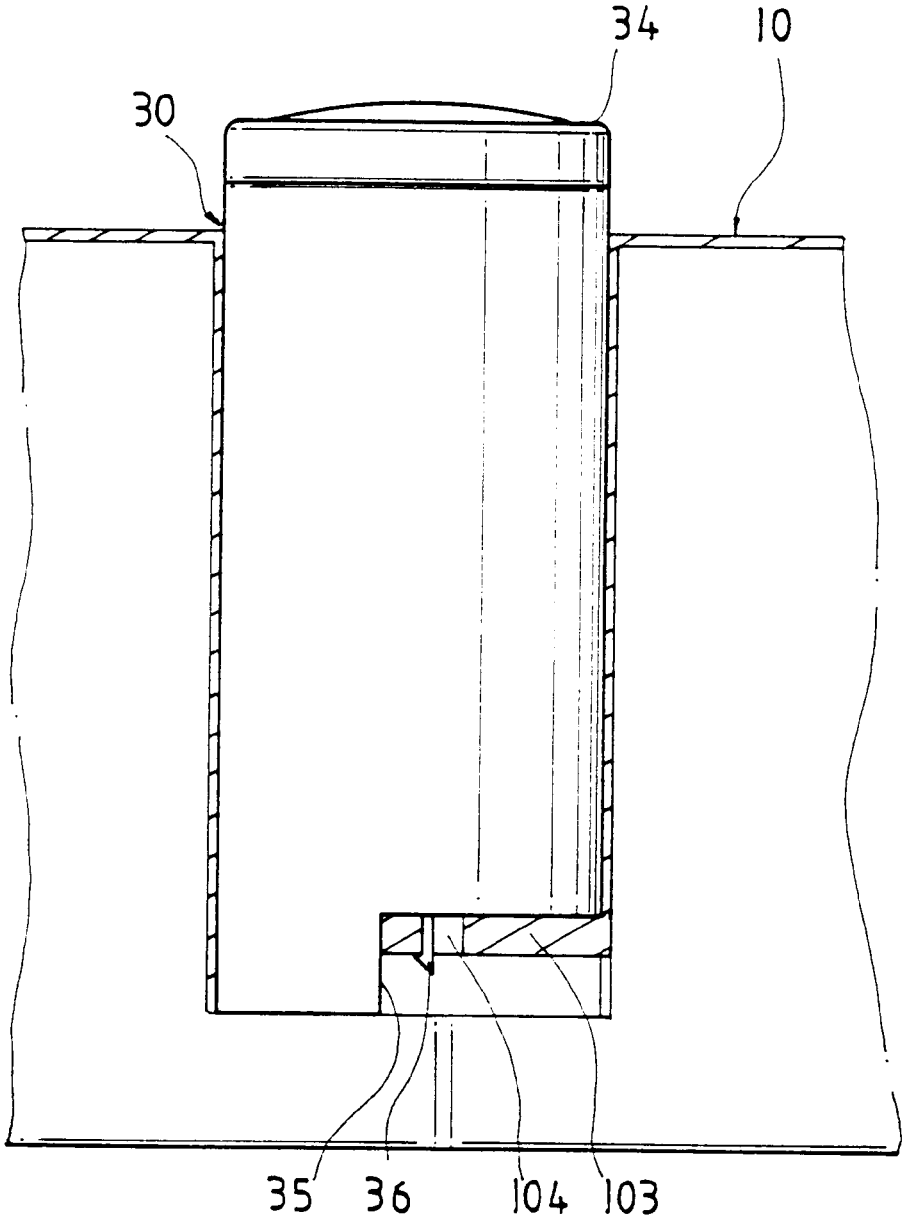
FIG. 2 is a sectional view showing the speaker cabinet mounted in the opening on the monitor housing according to the present invention.

Referring to FIGS. 1 and 2, a monitor housing 10 is shown having an opening 101 at one side remote from the display screen, two retaining notches 102 bilaterally disposed at the top side of the opening 101, a transverse supporting frame 103 disposed at the bottom side which has a plurality of locating slots 104. A cylindrical speaker cabinet 30 is mounted in the opening 101 on the monitor housing 10. The speaker cabinet 30 comprises a coupling groove 31 on the inside at one end which holds a voice output device 32. A cushion 33 is mounted in the coupling groove 31 around the voice output device 32. The cushion 33 can be, for example, a rubber ring. A cover 34 is fastened to one end of the speaker cabinet 30, and covered on the voice output device 32. The cover 34 comprises a plurality of air vents 341, and two projecting rods 342 raised from the periphery and adapted for coupling to the retaining notches 102 on the monitor housing 10. The speaker cabinet 30 comprises a recessed bottom coupling portion 35 at the bottom which fits the transverse supporting frame 103 on the monitor housing 10, and a downward hook 36 raised from recessed bottom coupling portion 35 and adapted for hooking on one locating slot 104 on the transverse supporting frame 103.

Figure 3:
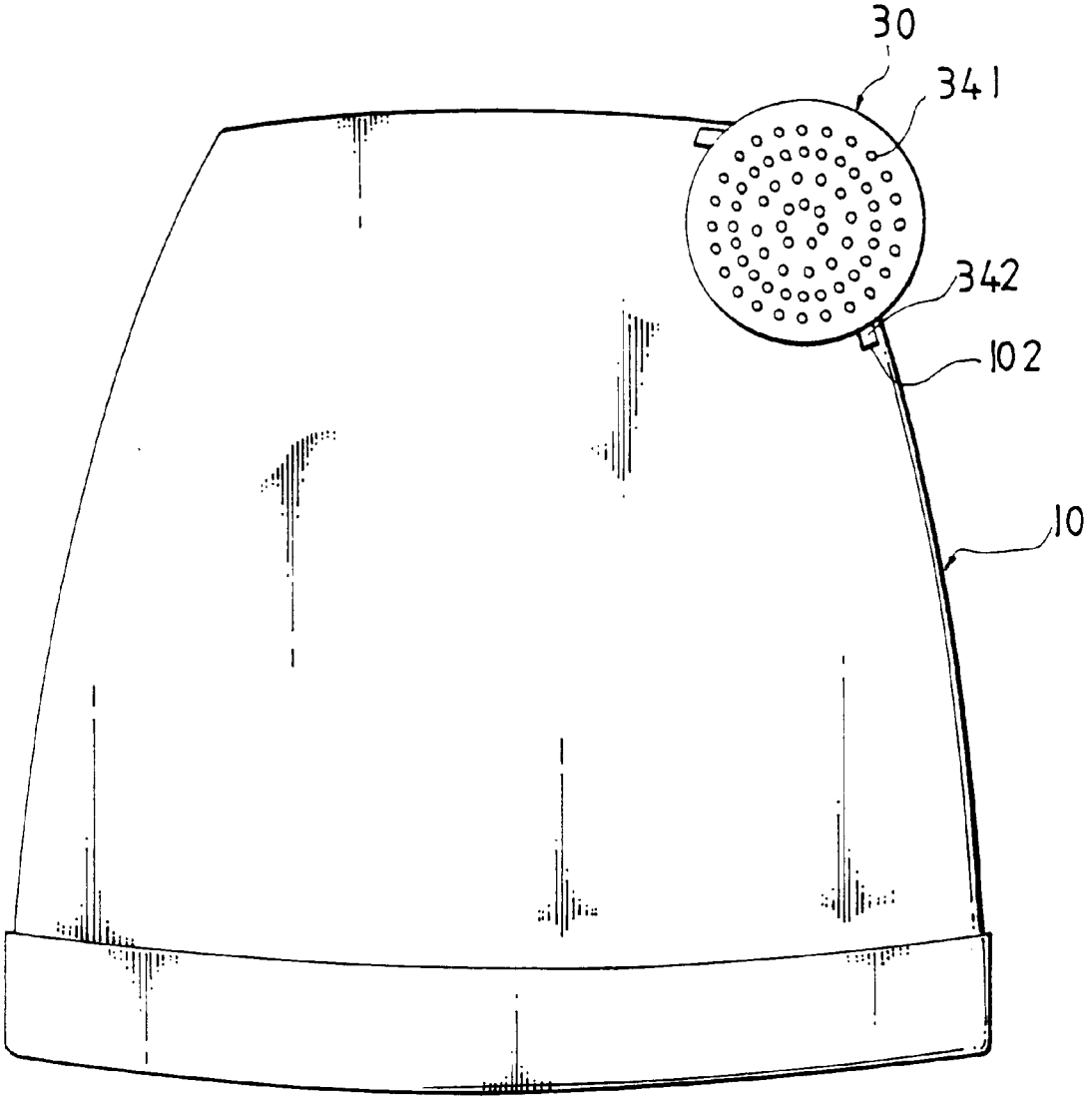
FIG. 3 is a top plain view showing the speaker cabinet mounted on the monitor housing according to the present invention.

Referring to FIG. 3, and also FIGS. 1 and 2, when the speaker cabinet 30 is inserted into the opening 101 on the monitor housing 10, the recessed bottom coupling portion 35 is supported on the transverse supporting frame 103 on the monitor housing 10, permitting the downward hook 36 and the projecting rods 342 to be respectively forced into engagement with one locating slot 104 on the transverse supporting frame 103 and the retaining notches 102 on the monitor housing 10. Because the speaker cabinet 30 is mounted in the opening 101 on the monitor housing 10, the installation of the speaker cabinet 30 occupies little table top space. Further, when the voice output device 32 is operated, vibrating waves are absorbed by the cushion 33, therefore the voice output quality is maintained.

While only one embodiment of the present invention has been shown and described, it will be understood that various modifications and changes could be made thereunto without departing from the spirit and scope of the invention disclosed. For example, two openings can be made on the monitor housing at two opposite sides for holding two speaker cabinets.

What the invention claimed is:

1. A speaker cabinet and monitor housing mounting arrangement comprising:

a monitor housing having at least one opening near a back side thereof remote from a display screen mounted thereon, at least one retaining notch at a first end of said at least one opening, and at least one locating slot at a second end of said at least one opening; and at least one speaker cabinet respectively mounted in said at least one opening, said at least one speaker cabinet comprising at least one projecting rod respectively fitted into the at least one retaining notch at the first end of the corresponding opening on said monitor housing, and at least one hook respectively hooked on the at least one locating slot at the second end of the corresponding opening on said monitor housing.

2. The speaker cabinet and monitor housing mounting arrangement of claim 1, wherein said at least one locating slot at a second end of said at least one opening is respectively formed in a supporting frame in the corresponding opening on said monitor housing; said at least one speaker cabinet comprises a recessed coupling portion fitting the supporting frame in the corresponding opening on said monitor housing.

3. The speaker cabinet and monitor housing mounting arrangement of claim 1, wherein said at least one speaker cabinet comprises a coupling groove on the inside at one end which holds a voice output device.

4. The speaker cabinet and monitor housing mounting arrangement of claim 3, wherein said at least one speaker cabinet is mounted with a shock absorbing cushion retained in the corresponding coupling groove around the corresponding voice output device.

5. The speaker cabinet and monitor housing mounting arrangement of claim 4, wherein said shock absorbing cushion is a rubber.

6. The speaker cabinet and monitor housing mounting arrangement of claim 1, wherein the at least one projecting rod of said at least one speaker cabinet is raised from a cover being covered on the respective speaker cabinet, said cover having a plurality of air vents.

* * * * *